US005905416A

United States Patent [19]

Schmid et al.

[11] Patent Number: 5,905,416

[45] Date of Patent: May 18, 1999

[54] DIE-CAST DUPLEXER

[75] Inventors: Hartmut Schmid; Gregory Deane Soderling, both of North Vancouver; Mihai Marcu, Pitt Meadows, all of Canada

[73] Assignee: Glenayre Electronics, Inc., Charlotte, N.C.

[21] Appl. No.: 09/004,212

[22] Filed: Jan. 8, 1998

[51] Int. Cl.[6] ..... H01P 1/213; H01P 1/205

[52] U.S. Cl. ..... 333/134; 333/203; 333/206

[58] Field of Search ..... 333/126, 129, 333/134, 136, 203, 206, 207, 222, 223, 224

[56] References Cited

U.S. PATENT DOCUMENTS

| | | | |
|---|---|---|---|
| 4,216,448 | 8/1980 | Kasuga et al. | 333/203 |
| 4,278,957 | 7/1981 | Sterai et al. | 333/223 X |
| 4,677,402 | 6/1987 | Cesani et al. | 333/203 |

FOREIGN PATENT DOCUMENTS

| | | | |
|---|---|---|---|
| 0540360 | 5/1993 | European Pat. Off. | 333/222 |

OTHER PUBLICATIONS

Telonic Engineering Corporation, "Band Pass Filters", Electronic Products, p. 21, Oct. 1961.

*Primary Examiner*—Robert Pascal
*Assistant Examiner*—Justin P. Bettendorf
*Attorney, Agent, or Firm*—Christensen O'Connor Johnson & Kindness PLLC

[57] ABSTRACT

A duplexer, usable to interlink a receiver unit, transmitter unit, and an antenna unit of a communication system, has a body that includes cavities and interconnecting apertures. The duplexer further includes resonator covers that cover the cavities and apertures from a bottom side of the body and tuning covers that cover the cavities and apertures from a top side of the body. The resonator covers have integral resonator posts that extend into the cavities when the resonator covers are press-fitted into the body. The tuning covers have threaded openings for the insertion of tuning screws into the cavities and for the insertion of coupling screws into the apertures. The cavities and apertures are tuned to reflect or pass signals of selected frequencies by turning the tuning screws and coupling screws.

8 Claims, 6 Drawing Sheets

DIE-CAST DUPLEXER

FIELD OF THE INVENTION

The present invention relates to communication systems and, more particularly, to improvements in duplexers used in such systems.

BACKGROUND OF THE INVENTION

In communication systems that employ a common antenna for use with a transmitter unit and a receiver unit, a duplexer interlinks the transmitter unit, the receiver unit, and the common antenna. A typical duplexer is a combination of bandpass and band-reject filters that allow signals from the transmitter to reach the antenna while preventing the transmit signals from reaching the receiver. Similarly, signals received by the antenna travel through the duplexer to the receiver, but are prevented from reaching the transmitter.

A traditional duplexer for use in the 800 MHz and greater range comprises a machined metallic block having a rectangular body with a top side and a base. The body consists of a series of cavities and interconnecting apertures, both of which are tuned to reflect or pass signals at selected frequencies. The cavities and interconnecting apertures are all open to the top side of the body and are closed to the base of the body. Resonator posts, which are an integral part of the body, extend upward from the base of the body. Each resonator post extends upward through the center of a cavity. A rectangular cover, having the same dimensions as the top side of the body, is attached to the top side of the body through the use of a large number of screws.

This prior art duplexer design is expensive and creates several problems. First, the structure of the body requires that each duplexer be machined from a solid block of aluminum, a process which is both labor intensive and costly. Second, the number of screws used to attach the cover to the body increases the parts cost and the labor cost of the duplexer. Finally, securing the wires around the resonator posts typically requires that the entire body of the duplexer be heated because the resonator posts are an integral part of the body. This creates a potential for warping and prevents testing before the entire assembly is complete.

Therefore, there is a need for a duplexer that is less expensive to manufacture, easier to assemble, and capable of being partially tested prior to the assembly of the entire duplexer.

SUMMARY OF THE INVENTION

The present invention is a duplexer having a rectangular body with a top side and a bottom side. The rectangular body is die-casted, machined, or partially machined and partially die-casted. Within the body are a series of cavities and interconnecting apertures. Each cavity is open to the top side and to the bottom side of the body, with the exception of the cavities at each end of the body, which are only open to the bottom side of the body. The apertures, however, are alternatingly open to the top side and the bottom side of the body so that any two cavities and the aperture between them form a single "peanut-shaped" opening on either the top side or the bottom side of the body.

The duplexer further includes a number of resonator covers. Each resonator cover is dimensioned to fit snugly over a pair of cavities and the aperture between them on the bottom side of the body. In addition, each resonator cover includes a pair of integrally formed resonator posts. When the resonator covers are pressed into the peanut-shaped openings, each resonator post extends into a corresponding cavity. The resonator covers on each end of the body of the duplexer have a radio frequency (RF) connector at the perimeter of the cover and an internal wire connection from the connector to and around the post nearest the connector. A resonator cover in the center of the body has an RF connector located in the center of the cover and the internal wire connections are made from the RF connector to and around both of the resonator posts of the center resonator cover.

The duplexer also includes a number of tuning covers to fit snugly over the peanut-shaped openings on the top side of the duplexer. Each tuning cover has two identical threaded holes. A tuning screw is inserted into each threaded hole and is extended into the center of a corresponding cavity. Each tuning cover also includes a center threaded hole for the insertion of a coupling screw into a corresponding aperture.

All the tuning covers and the resonator covers are pressed into the body of the duplexer, with the tuning covers on the top side and resonator covers on the bottom side of the body. The stress created from press-fitting the tuning covers into the top side of the body is counterbalanced by the stress created by press-fitting the resonator covers into the bottom side of the body. To aid in the press-fitting process, the edges of the resonator covers and the tuning covers are tapered. In addition, each resonator cover and tuning cover has a groove along the perimeter, allowing the cover to flex and conform to the opening on the body in order to make a good seal without placing great stress on the body of the duplexer.

In the preferred embodiment, the covers and the body are designed to be die-cast. Furthermore, the body includes mounting posts and alignment posts to mount and align the duplexer with a circuit board. The face of the mounting posts may be segmented to allow automatic detection of the orientation of the duplexer.

When the duplexer is mounted onto a circuit board, one of the end RF connectors connects to a transmitter unit and the other end RF connector connects to a receiver unit. The center RF connector connects to an antenna. The RF connectors receive radio frequency signals. The signals travel by electromagnetic waves through the apertures. The cavities and apertures are tuned by the tuning screws and coupling screws to pass or reflect signals at selected frequencies.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention is a duplexer that is constructed such that it can be manufactured by die-casting, machining, or partial die-casting and partial machining. In addition, the duplexer can be partially tested prior to being fully assembled.

Figure 1A:
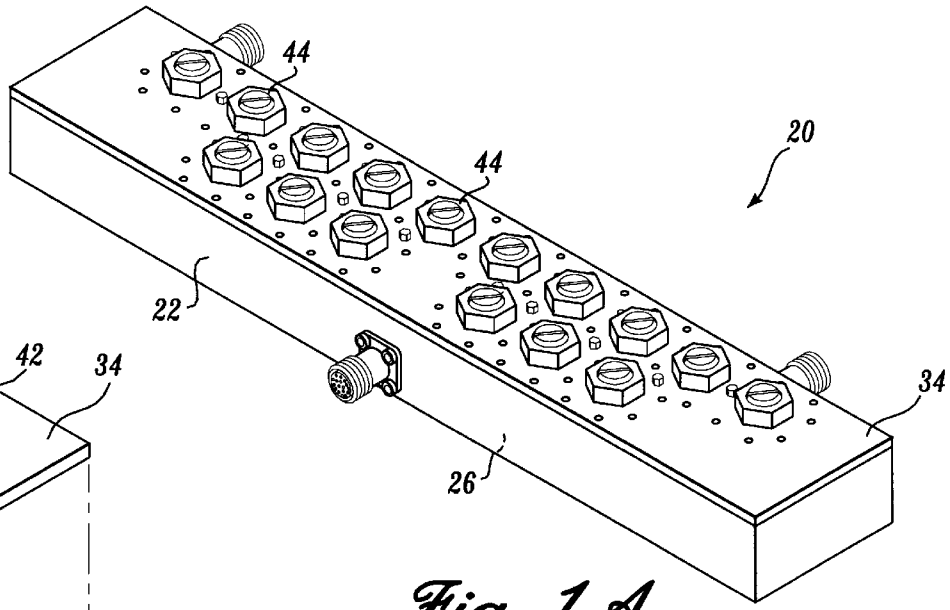
Fig. 1A. PRIOR ART
FIG. 1A is a perspective top view of an assembled prior art duplexer.
Figure 1B:
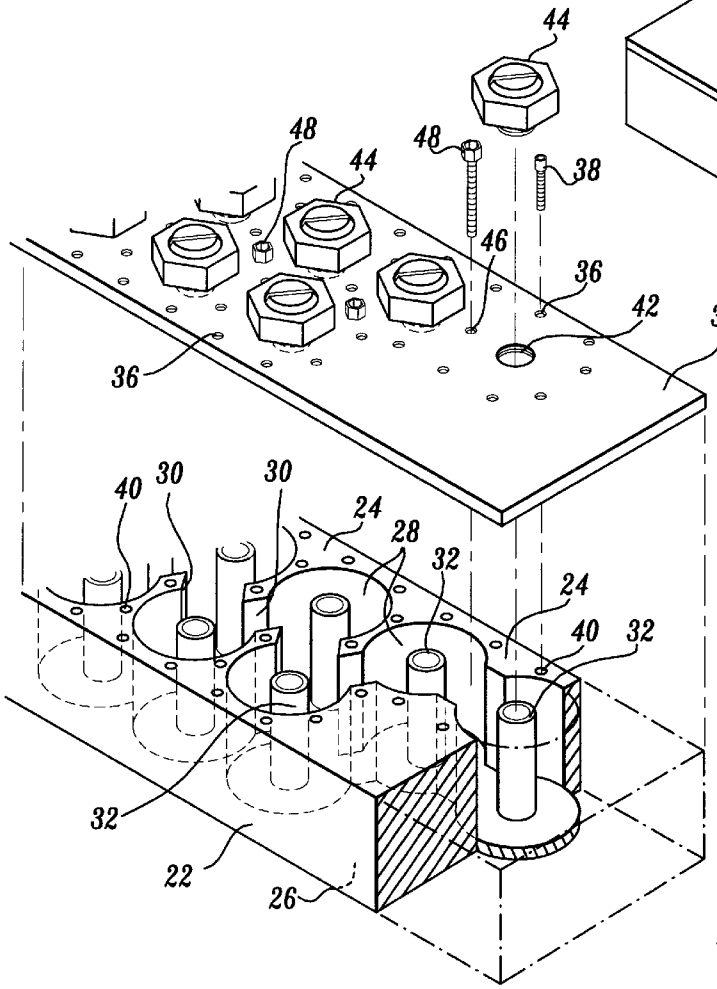
Fig. 1B. PRIOR ART
FIG. 1B is a partial perspective top view of a body of the prior art duplexer, with a cover shown in an exploded relationship.

FIGS. 1A and 1B illustrate a prior art duplexer 20 for use in the 800 MHz and greater range. FIG. 1A shows the prior art duplexer 20 in its assembled form and FIG. 1B shows the prior art duplexer in its disassembled form. The prior art duplexer includes a body 22 having a top side 24 and a bottom side 26. The body 22 consists of a series of cavities 28 and interconnecting apertures 30. The cavities 28 and apertures 30 are all open to the top side 24 of the body 22 and are closed to the bottom side 26 of the body 22. Within the center of each cavity is a resonator post 32, which is an integral part of the body and extends upward from the bottom side 26 of the body 22.

A rectangular cover 34 is placed on the top side 24 of the body 22 and is secured by a number of screws 38. The screws 38 are inserted through a series of clearance holes 36 on the cover 34 and engage a series of corresponding threaded holes 40 on the body 22 that are positioned around the edges of the cavities 28. The cover 34 also has a number of threaded openings 42 positioned over the center of each cavity that allow the insertion of a tuning screw 44 into the center of the cavity 28. Additionally, the cover 34 has threaded openings 46 positioned over each aperture 30 that allow the insertion of a coupling screw 48 that extends into the center of an aperture, when the cover 34 is attached to the body 22.

As indicated above, the problem with the prior art duplexer shown in FIGS. 1A and 1B is that it is costly to manufacture and to assemble. In addition, because the resonator posts are an integral part of the body of the duplexer, the entire duplexer must be heated in order to secure a wire to the resonator post. It is not only difficult to achieve a solid electrical connection, but the heating can warp the duplexer.

Figure 2:
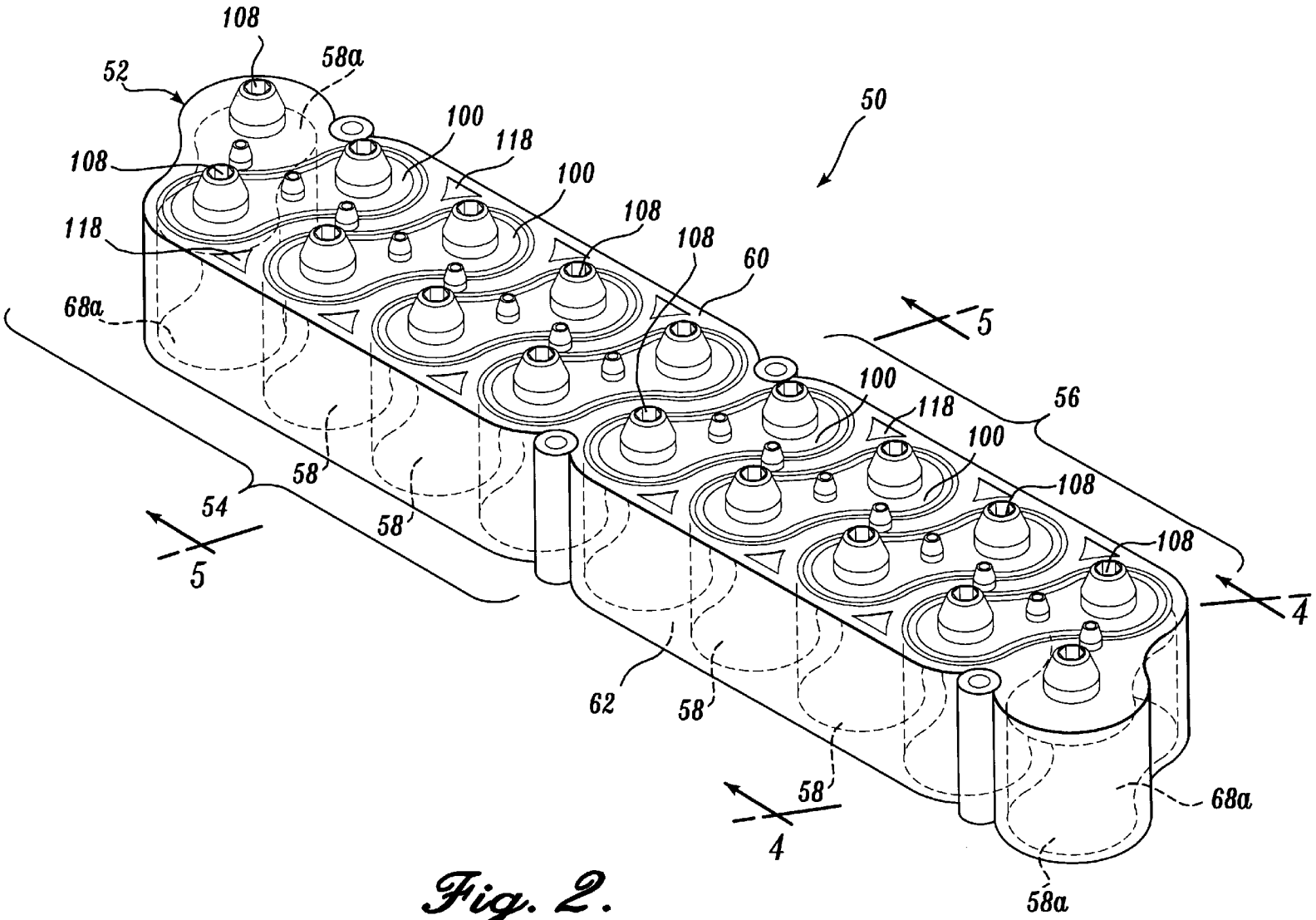
FIG. 2 is a perspective top view of a preferred embodiment of an assembled duplexer according to the present invention.

FIG. 2 illustrates a duplexer 50 according to the present invention in its preferred embodiment. In the preferred embodiment, the duplexer 50 is made by a die-casting process. The duplexer 50 has a body 52 that is generally divided into a receive portion 54 and a transmit portion 56. The receive portion 54 and the transmit portion 56 each have at least three circular cavities 58, but each may contain as many as nine or more cavities 58. Each of the cavities 58 is open on both a top side 60 and a bottom side 62 of the body 52, with the exception of two end cavities 58*a* which are open only on the bottom side 62 of the body 52.

Figure 3:
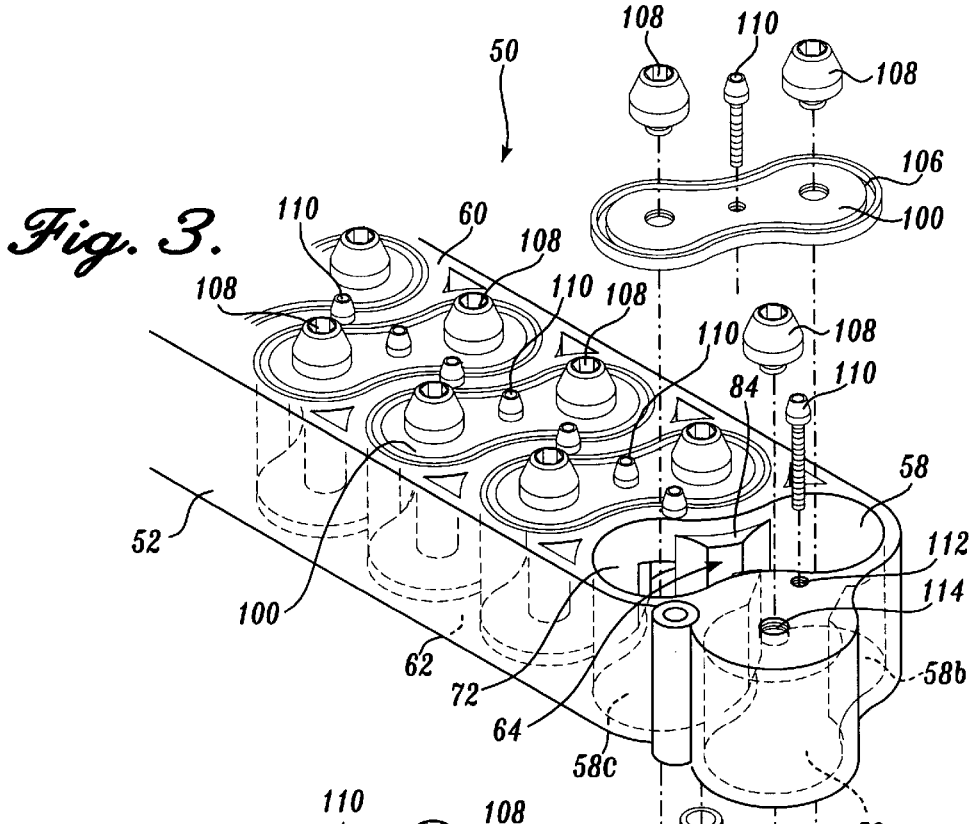
FIG. 3 is a partial perspective top view of a body of the duplexer, along with two resonator covers, one tuning cover, and accompanying tuning and coupling screws shown in an exploded relationship.

As shown in FIG. 3, the body 52 also includes a number of rectangular apertures 64 that interconnect diagonally adjacent cavities 58 on the receive portion 54 of the duplexer and diagonally adjacent cavities 58 on the transmit portion 56 of the duplexer. The apertures are alternatingly open to the top side 60 and the bottom side 62 of the body 52. Thus, any two cavities 58 and the aperture 64 between them form a peanut-shaped opening 68. All the peanut-shaped openings are identical both in size and in shape. The peanut-shaped openings 68 on the receive portion 54 are linked, whereby each opening 68 shares a common cavity or common cavities with its one or two adjacent openings on the same side such that openings on the top side 60 are aligned in one direction, in a slanted arrangement, and the openings on the bottom side 62 are aligned in another direction, also in a slanted arrangement. Likewise, the openings 68 on the transmit portion 56 are linked, whereby each opening 68 shares a common cavity or common cavities with its one or two adjacent openings on the same side of the body 52. For example, moving from the right-hand to the left-hand side of the body 52, the end cavity 58*a* and a second cavity 58*b* are linked through an aperture 64, while the second cavity 58*b* is also linked to a third cavity 58*c* through another aperture 64, and so on.

As shown in FIG. 3, each pair of cavities and the aperture between them on the bottom side 62 of the body 52 is covered by a resonator cover 80. The resonator covers 80 are dimensioned to fit snugly into the peanut-shaped openings 68 formed by the cavities 58 and apertures 64. Each resonator cover 80 has a pair of resonator posts 82 that are integrally formed with a resonator cover. The pair of resonator posts 82 extend in a direction normal to the plane of the resonator cover, wherein each resonator post is positioned to extend into the center of a corresponding cavity 58 when the resonator cover 80 is installed into the body 52. The resonator covers 80 are pressed into the peanut-shaped openings 68 and rest on a ledge 84 that is formed by a side edge of the aperture 64. For ease of press-fitting, the perimeter of the resonator covers can be tapered. In addition, the resonator covers 80 have a groove 81 formed around the perimeter of the resonator covers 80 to enable the resonator covers to flex and conform to the peanut-shaped openings 68, thereby reducing stress on the body 52 of the duplexer while forming a good seal between the resonator covers 80 and the body 52 of the duplexer 50.

Figure 5:
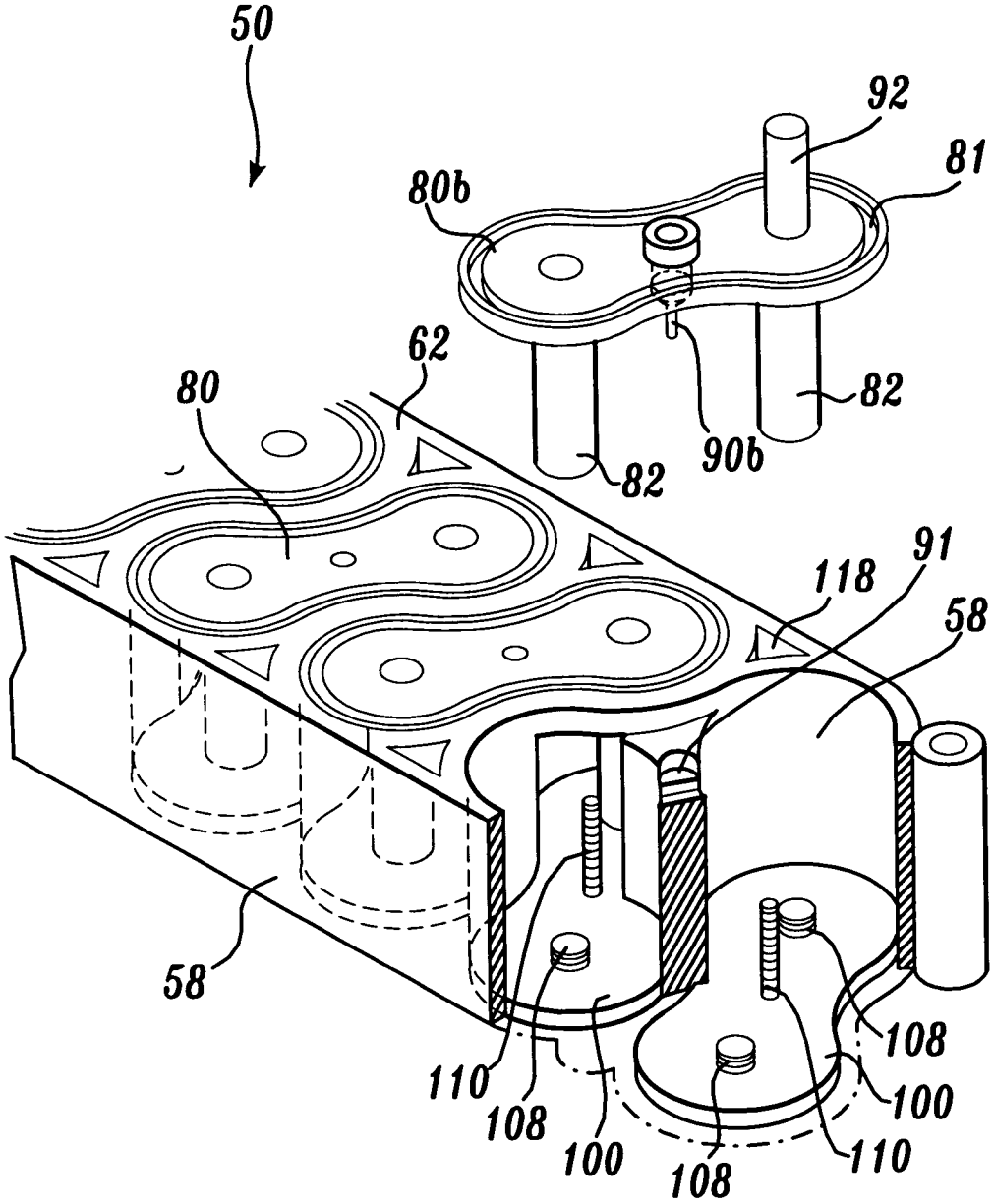
FIG. 5 is a partial perspective bottom view of a center portion of the body, with a center resonator cover shown in an exploded relationship.
Figure 6:
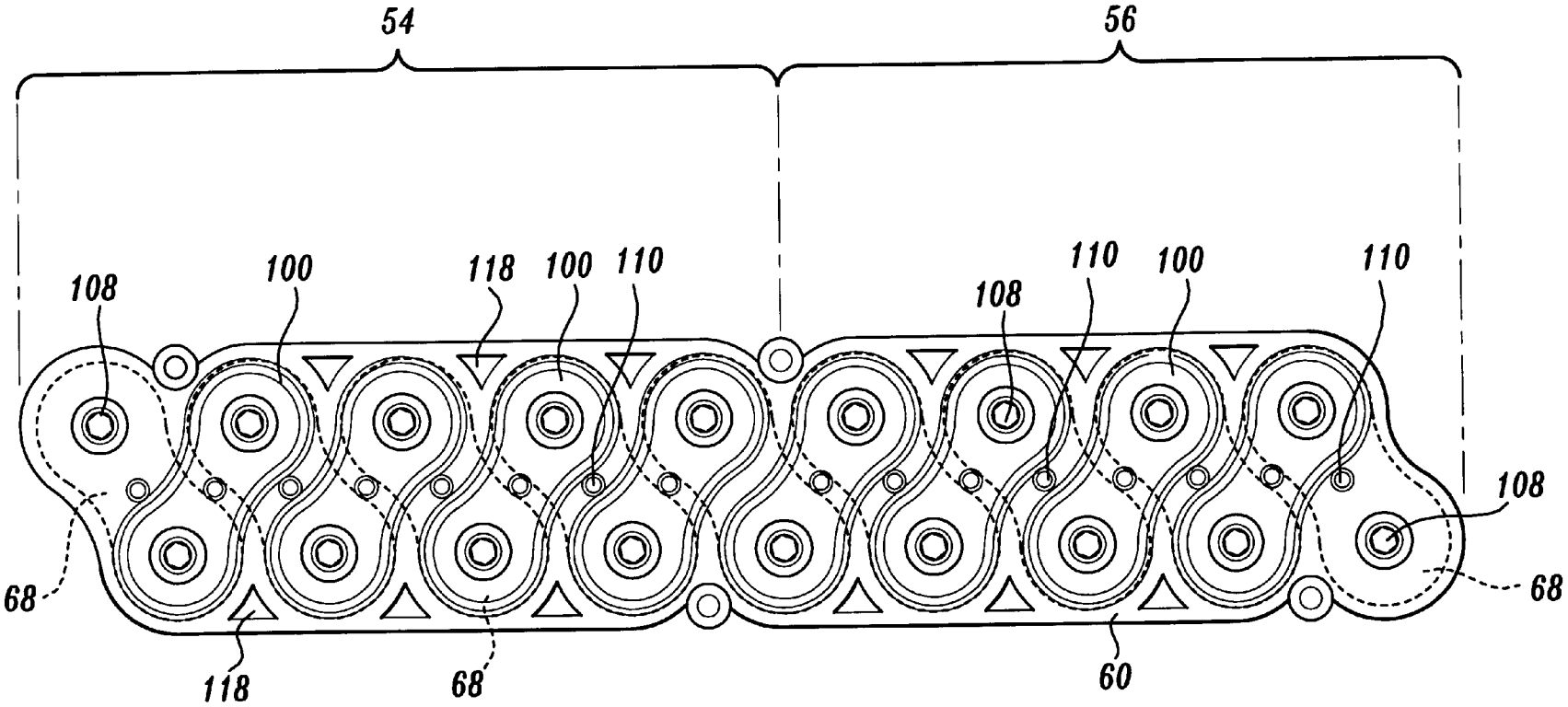
FIG. 6 is a top plan view of the duplexer according to the present invention.

An end resonator cover 80*a* that fits into end peanut-shaped openings 68*a* on the bottom side 62 of the body 52 has an end radio frequency (RF) connector 90*a* and a wire connection (not shown) that extends from the RF connector 90*a* to and around the nearest resonator post 82 of the end resonator cover 80*a*. As shown in FIG. 5, a center resonator cover 80*b* that spans between the receive portion 54 and the transmit portion 56 has a center RF connector 90*b* at the center between the two circular ends of the resonator cover 80*b* and wire connections (not shown) that extend from the center RF connector 90*b* to and around the two resonator posts 82 of the center resonator cover 80*b*. An indentation 91, dimensioned to receive the center RF connector 90*b* when the center resonator cover 80*b* is installed, is formed within a wall that separates the cavities on the transmit side of the duplexer from the cavities on the receive side of the duplexer.

The end resonator covers 80*a* and the center resonator cover 80*b* each has an alignment post 92 that is aligned with a resonator post but extends outwardly from the face of the cover. The alignment posts 92 plug into a circuit board (not shown) to ensure that the RF connectors 90*a*, 90*b* are aligned with the circuit board.

Figure 4:
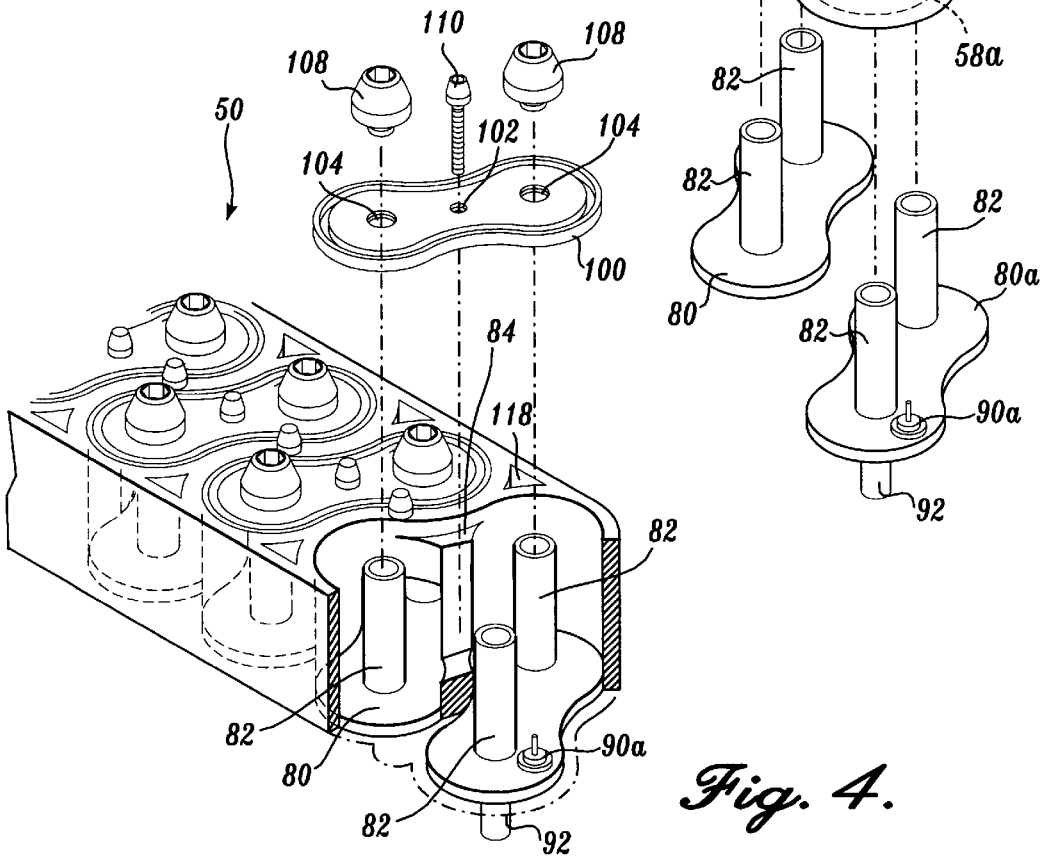
FIG. 4 is a partial perspective top view of a body of the duplexer according to the present invention that illustrates the interior of the cavities, along with a tuning cover and accompanying tuning and coupling screws shown in an exploded relationship.

As shown in FIGS. 3 and 4, each pair of cavities 58 and the aperture 64 between them on the top side 60 of the body 52 are covered by a tuning cover 100. The tuning covers are dimensioned to fit snugly into the peanut-shaped openings 68 formed by the cavities 58 and apertures 64. Each tuning cover has a threaded hole 102 in the center of the tuning cover 100, positioned so that the threaded hole 102 lies above an aperture 64 when the tuning cover 100 is installed. In addition, each tuning cover 100 includes a pair of threaded holes 104, positioned so that the threaded holes 104 are aligned with the resonator posts 82 that extend into the center of the cavities 58 when the duplexer 50 is assembled. The tuning covers 100 are pressed into the top side 60 of the body 52. For ease of press-fitting, the perimeter of the tuning covers 100 can be tapered. In addition, the tuning covers 100 have a groove 106 that is formed around the perimeter of the tuning covers 100 to enable the tuning covers to flex and conform to the openings 68, thereby reducing stress on the body 52 while forming a good seal between the tuning covers 100 and the body 52.

Tuning screws 108 are secured into the pairs of threaded holes 104 on the tuning covers 100 and extend into the center of the cavities 58. Coupling screws 110 are inserted into the threaded holes 102 in the center of the tuning cover 100 and extend into the apertures 64.

As shown in FIG. 3, a number of threaded holes 112 are formed on the top side 60 of the body 52 above the apertures 64 that open to the bottom side 62 of the body 52. Coupling screws 110 are inserted into the threaded holes 112 and extend into the apertures 64. In addition, a number of threaded holes 114 are formed on the top side 60 of the body 52 above the end cavities 58*a*. Tuning screws 108 are inserted into the threaded holes 114 and extend into the center of the end cavities 58*a*.

Returning to FIG. 2, the duplexer 50 is mounted onto a circuit board by a number of mounting posts 116 that are an integral part of the body 52. When secured to the circuit board, one of the end RF connectors 90*a* connects to a transmitter unit (not shown), while the other end RF connector 90*a* connects to a receiver unit (not shown). The center RF connector 90*b* connects to an antenna (not shown). The RF connectors 90*a*, 90*b* receive radio frequency signals. The signals travel by electromagnetic waves from one cavity to another through the interconnecting apertures 64. The cavities 58 and apertures 64 are tuned by turning the tuning screws 108 and the coupling screws 110 to pass or reflect signals at selected frequencies.

The structure of the duplexer 50 according to the present invention presents many advantages. First of all, the wire connections made between the RF connectors 90*a*, 90*b* and the resonator posts 82 can be conveniently and easily made before the resonator covers 80, 80*a* are pressed into the body 52. This allows the connections to be tested prior to assembly of the entire duplexer 50. Secondly, because the resonator posts 82 are not an integral part of the body 52, soldering the wires to the resonator posts can be accomplished without having to heat the entire body 52, thereby reducing the potential for warping and oxidation. Alternatively, a spring-clip (not-shown) may be secured to the resonator post to make the electrical connection.

In addition, press-fitting the resonator covers 80 and the tuning covers 100 into the body 52 creates a further advantage by eliminating the need for screws to mount the covers. As shown in FIG. 1A, the prior art duplexers 20 require numerous screws 38 to attach the rectangular cover 34 onto the body 22. The stresses created by the press-fitting process do not bend the body 52 of the duplexer 50 because the stress from press-fitting the resonator covers 80 is counterbalanced by the stress from press-fitting the tuning covers 100 into the body 52. Furthermore, the grooves 106 on the tuning covers 100 and the grooves 81 on the resonator covers 80 reduce stress on the body 52 by allowing the covers 80 and 100 to flex and to conform to the peanut-shaped openings 68 on the body 52.

Furthermore, the diagonal symmetry of the body 52, from left to right, enables easy switching of a transmit frequency and a receive frequency. The transmit and receive frequencies can be interchanged by merely changing the connections from the end RF connectors 90*a* to the transmitter unit and the receiver unit.

Finally, the design of the body 52 and the covers 80 and 100 enables the body and the covers to be die-cast. Die-casting is generally preferable to machining due to reduced cost.

Figure 7:
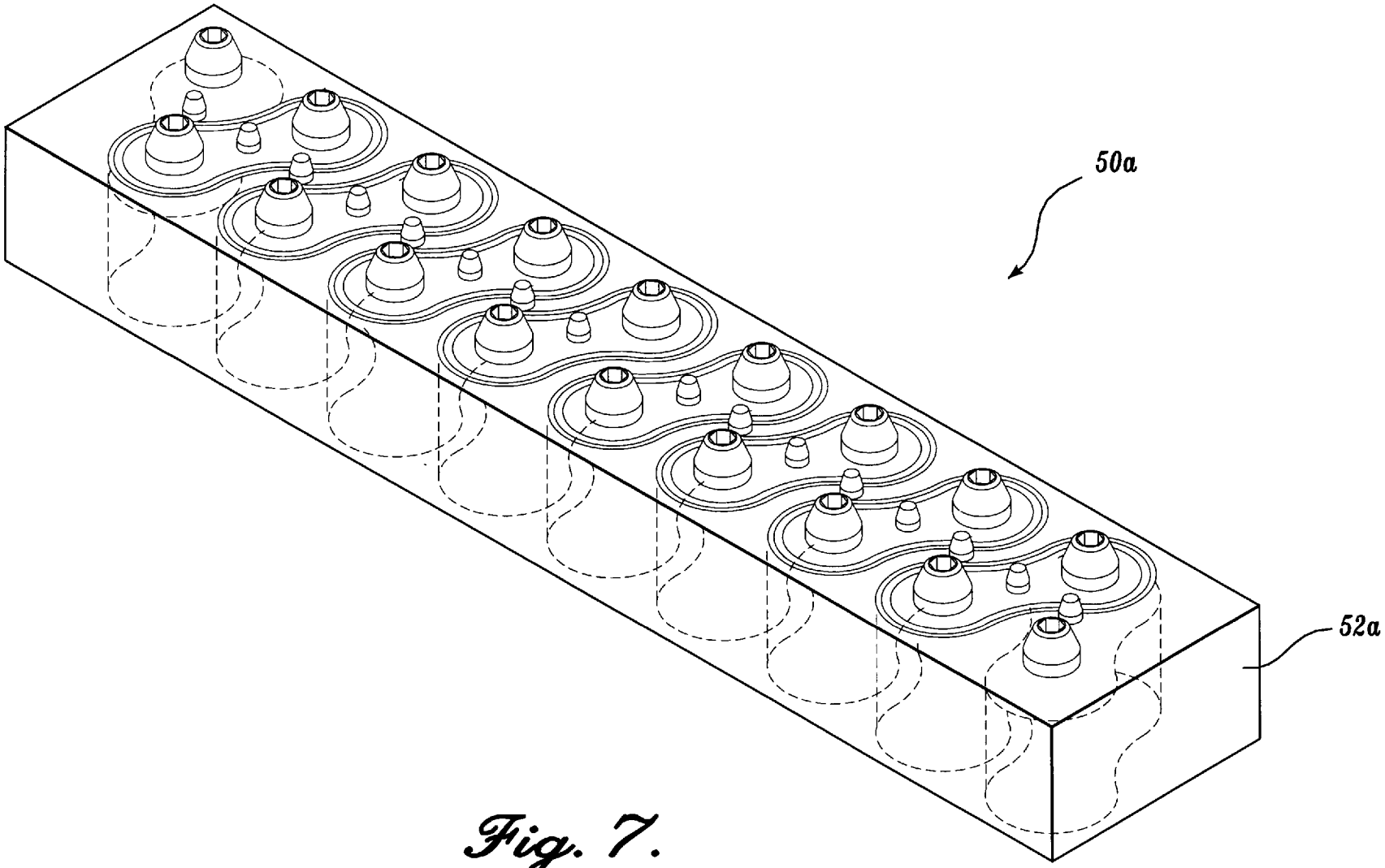
FIG. 7 is a perspective top view of an alternative embodiment of an assembled duplexer according to the present invention.

FIG. 7 illustrates an alternative embodiment of a duplexer 50*a* according to the present invention. The duplexer 50*a* according to the alternative embodiment is similar to the duplexer 50 according to the preferred embodiment, with the main difference being that a body 52*a* of the duplexer 50*a* according to the alternative embodiment is completely rectangular in shape, while the body 52 of the duplexer 50 according to the preferred embodiment follows the shape of the cavities and apertures. In addition, the body 52 of the duplexer 50 according to the preferred embodiment has triangular holes 118 through the body 52 between the circular portions of the peanut-shaped openings 68 to lighten the body 52, while the body 52*a* of the duplexer 50*a* according to the alternative embodiment does not. The duplexer 50*a* shown in FIG. 7 is made by a machining process rather than a die-casting process used to make the duplexer 50 shown in FIG. 2.

While the preferred embodiment of the invention has been illustrated and described, it will be appreciated that various changes can be made therein without departing from the spirit and scope of the invention. For example, the number and shape of the cavities and apertures can be varied to accommodate the application involved. The tuning and resonator covers can be soldered rather than pressed into place. In addition, different types of tuning screws may be used, such as nylon-locking screws or screws used in conjunction with nuts. Also, instead of using a plurality of resonator covers, each one having two resonator posts, one rectangular resonator cover integrally having all the resonator posts positioned to extend into the cavities may be used. Likewise, one rectangular tuning cover having all the necessary threaded holes may be used or the tuning covers can be eliminated altogether and the threaded holes can be formed in the body instead. Additionally, the body may be made from two body halves that are precisely indexed, and joined with conductive adhesive, soldered, mechanically swaged or any combination thereof The upper half has holes for all the tuning screws and the lower includes all the resonator posts except the three covers with the RF connectors. The three covers with the RF connectors would still be pressed or soldered into the body after the electrical connections are made and after testing.

Furthermore, different types of material may be used to make the body and the covers including, but not limited to, gold-plated or silver-plated aluminum, metal-coated plastic, or metal-coated ceramic.

The embodiments of the invention in which an exclusive property or privilege is claimed are defined as follows:

1. A method for manufacturing a duplexer, said method comprising the steps of:

forming by die casting a body having a top side, a bottom side, a plurality of cavities that are open to both the top side and the bottom side of the body and a plurality of interconnecting apertures that are open to either the top side or the bottom side of the body;

forming a resonator cover to cover the cavities and the interconnecting apertures from the bottom side of the body, wherein the resonator cover includes a plurality of integrally formed resonator posts;

forming a tuning cover to cover the cavities and the interconnecting apertures from the top side of the body, wherein the tuning cover includes a plurality of openings for the insertion of tuning screws and coupling screws;

securing said resonator cover into the bottom side of the body such that each resonator post extends into a corresponding cavity when the resonator cover is secured to the bottom side of the body; and securing said tuning cover into the top side of the body such that each tuning screw extends into a corresponding cavity and each coupling screw extends into a corresponding aperture when said tuning cover is secured to the top side of said body.

2. A duplexer comprising:

a body having a top side, a bottom side, a plurality of cavities that are open to both the top side and the bottom side of the body and a plurality of interconnecting apertures that are open to either the top side or the bottom side of the body;

a resonator cover to cover the cavities and the interconnecting apertures from the bottom side of the body, wherein the resonator cover includes a plurality of integrally formed resonator posts, and wherein each resonator post extends into a corresponding cavity when the resonator cover is secured to the bottom side of the body; and a tuning cover to cover the cavities and the interconnecting apertures from the top side of the body, wherein the tuning cover includes a plurality of openings for the insertion of tuning screws and coupling screws, and wherein each tuning screw extends into a corresponding cavity and each coupling screw extends into a corresponding aperture when said tuning cover is secured to the top side of said body.

3. A duplexer comprising:

a body having a plurality of cavities that are open on both a top side and a bottom side of the body and a plurality of interconnecting apertures that connect adjacent cavities, wherein the apertures are alternately open to either the top side or the bottom side of the body;

a plurality of resonator covers, wherein each resonator cover includes resonator posts, and wherein each resonator cover covers an opening on the bottom side of the body that is created by a pair of adjacent cavities and an interconnecting aperture with each resonator post extending into a corresponding cavity when the resonator covers are assembled onto the bottom side of the body; and a plurality of tuning covers, wherein each tuning cover includes openings for the insertion of tuning screws into a corresponding cavity and an opening for the insertion of a coupling screw into a corresponding aperture, and wherein each tuning cover covers an opening on the top side of the body that is created by a pair of adjacent cavities and an interconnecting aperture when the tuning covers are assembled onto the top side of the body.

4. The duplexer of claim 3, wherein the resonator covers and the tuning covers are press-fitted into said body.

5. The duplexer of claim 4, wherein the resonator covers and the tuning covers have a groove formed along the perimeter of the resonator covers and the tuning covers.

6. The duplexer of claim 4, wherein edges of the resonator covers and the tuning covers are tapered.

7. The duplexer of claim 3, wherein the plurality of cavities and interconnecting apertures define a transmit portion and receive portion of the duplexer, each of which is tuned to pass and reject electromagnetic signals at predefined frequencies.

8. The duplexer of claim 7, wherein the transmit portion and the receive portion of the duplexer are symmetrically arranged about a center of the duplexer.

* * * * *